US011210973B2

(12) United States Patent
Liu et al.

(10) Patent No.: US 11,210,973 B2
(45) Date of Patent: Dec. 28, 2021

(54) WHEEL DYNAMIC IMAGING DISPLAY RACK

(71) Applicant: CITIC Dicastal CO., LTD., Qinhuangdao (CN)

(72) Inventors: Weidong Liu, Qinhuangdao (CN); Shiwen Xu, Qinhuangdao (CN); Dexi Du, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 94 days.

(21) Appl. No.: 16/700,247

(22) Filed: Dec. 2, 2019

(65) Prior Publication Data

US 2020/0410912 A1 Dec. 31, 2020

(30) Foreign Application Priority Data

Jun. 27, 2019 (CN) ..... 201910565517.8

(51) Int. Cl.

| | |
|---|---|
| ***G09F 13/30*** | (2006.01) |
| ***G09F 21/04*** | (2006.01) |
| ***F21S 9/02*** | (2006.01) |
| ***G09F 13/00*** | (2006.01) |
| *F21Y 115/10* | (2016.01) |

(52) U.S. Cl.

CPC ..... *G09F 21/045* (2013.01); *F21S 9/02* (2013.01); *G09F 13/005* (2013.01); *G09F 13/30* (2013.01); *F21Y 2115/10* (2016.08)

(58) Field of Classification Search

CPC ..... G09F 21/04; G09F 21/043; G09F 21/045; G09F 13/005; G09F 13/30; G09F 19/02; G09F 19/12; G09F 9/33; F21S 9/02; F21Y 2115/10; A47F 5/025; A47F 7/0057; A47F 11/10; B60C 13/001; B60Q 1/326; B62J 6/20

See application file for complete search history.

(56) References Cited

U.S. PATENT DOCUMENTS

| | | | | | |
|---|---|---|---|---|---|
| 4,689,604 | A * | 8/1987 | Sokol | G09G 3/005 | 345/31 |
| 5,057,827 | A * | 10/1991 | Nobile | G09G 3/005 | 345/31 |
| 5,818,401 | A * | 10/1998 | Wang | G09G 3/005 | 345/31 |
| 6,856,303 | B2 * | 2/2005 | Kowalewski | G09G 3/005 | 345/108 |
| 8,411,108 | B2 * | 4/2013 | Gilbert | G06T 15/00 | 345/619 |
| 8,866,703 | B2 * | 10/2014 | Weiss | G06F 3/03545 | 345/31 |
| 2005/0140201 | A1 * | 6/2005 | Wang | B60B 7/20 | 301/37.101 |
| 2007/0119081 | A1 * | 5/2007 | Kazunao | G09F 21/045 | 40/587 |

(Continued)

*Primary Examiner* — Cassandra Davis
(74) *Attorney, Agent, or Firm* — IPRO, PLLC

(57) ABSTRACT

Disclosed is a wheel dynamic imaging display rack which comprises a frame. A sleeve is fixed to the frame. A hollow shaft motor is fixed to the sleeve. The hollow shaft of the hollow shaft motor is fixedly connected to the wheel through the sleeve, the hollow shaft motor can drive the flange, the wheel and the LED lamp blade to rotate, and clear images are shown in the LED lamp blade.

7 Claims, 3 Drawing Sheets

(56) References Cited

U.S. PATENT DOCUMENTS

| | | | | |
|---|---|---|---|---|
| 2012/0200401 | A1* | 8/2012 | Goldwater | G09G 3/005 340/432 |
| 2017/0124925 | A1* | 5/2017 | Chykeyuk | G09G 3/001 |
| 2017/0136813 | A1* | 5/2017 | Becker | B60B 7/16 |
| 2019/0291507 | A1* | 9/2019 | Li | B60B 7/066 |

* cited by examiner

WHEEL DYNAMIC IMAGING DISPLAY RACK

CROSS-REFERENCE TO RELATED APPLICATION

This application claims the priority to Chinese Patent Application No. 2019105655178, entitled "Wheel Dynamic Imaging Display Rack", filed on Jun. 27, 2019, the entire content of which is hereby incorporated by reference.

TECHNICAL FIELD

The present disclosure relates to a wheel, and in particular relates to a wheel dynamic imaging display rack.

BACKGROUND

In order to meet the requirements of safety, stability, maneuverability, comfort, energy conservation and environmental protection, the hub is required to have high precision of size and shape, good dynamic balance, high fatigue strength, good rigidity and elasticity, light weight, beautiful appearance, recyclable materials, etc. And good integrated performance of the aluminum hub plays an important role in safety, beautiful appearance, comfort, recycle and lightweight (at least 30% mass reduction) and so on, especially in the beauty and the fashion, it has won the favor of the market and become the best choice. The loading capacity has exceeded 60% of the automobile output.

SUMMARY

In view of this, the disclosure aims to provide a wheel dynamic imaging display rack, which can meet the needs of dynamic display of the wheel hub, and has the characteristics of simple structure, stable performance, safety and reliability.

In order to achieve the above object, the technical solutions of the present disclosure are achieved as follows:

A wheel dynamic imaging display rack comprises a frame, a sleeve is fixed to the frame, a hollow shaft motor is fixed to the sleeve, the hollow shaft of the hollow shaft motor is fixedly connected to the wheel through the sleeve, a positioning frame passing through the hollow shaft is disposed in the hollow shaft of the hollow shaft motor, one end of the positioning frame is fixed to the frame, the other end of the positioning frame is fixed with an LED lamp holder assembly, an LED lamp blade is provided on the outer surface of the spoke of the wheel, and the LED lamp holder assembly can control the image display of the LED lamp blade.

In one embodiment, the hollow shaft is fixedly connected to the wheel by means of a flange, one end of the flange is fixedly connected to a flange surface of the wheel, and the other end of the flange is fixedly connected to the hollow shaft.

In one embodiment, the other end of the flange is fixedly connected to the hollow shaft by means of a pin and/or a key.

In one embodiment, a protective device is provided at the outside of the rim of the wheel, a transparent protective cover is provided at the outside of the spoke of the wheel, and the transparent protective cover is fixed to the protective device.

In one embodiment, a positioning seat fixed to the frame is provided at the outside of the hollow shaft motor, one end of the positioning frame is fixed to the positioning seat, and the other end of the positioning frame is fixed with the LED lamp holder assembly.

In one embodiment, the LED lamp holder assembly comprises a storage battery and a controller, the storage battery can supply power to the LED lamp blade, and the controller can control the image display of the LED lamp blade.

In one embodiment, the LED lamp blade comprises a plurality of display lamp beads.

Compared with the prior art, the wheel dynamic imaging display rack of the present disclosure has the following advantages:

The present disclosure can meet the needs of dynamic display of the wheel hub, and has the characteristics of simple structure, stable performance, safety and reliability.

BRIEF DESCRIPTION OF THE DRAWINGS

The drawings forming a part of the disclosure are used to provide a further understanding of the present disclosure, and the illustrative embodiments of the present disclosure and the description thereof are intended to explain the present disclosure and are not intended to limit the present disclosure. In the drawings.

Figure 1:
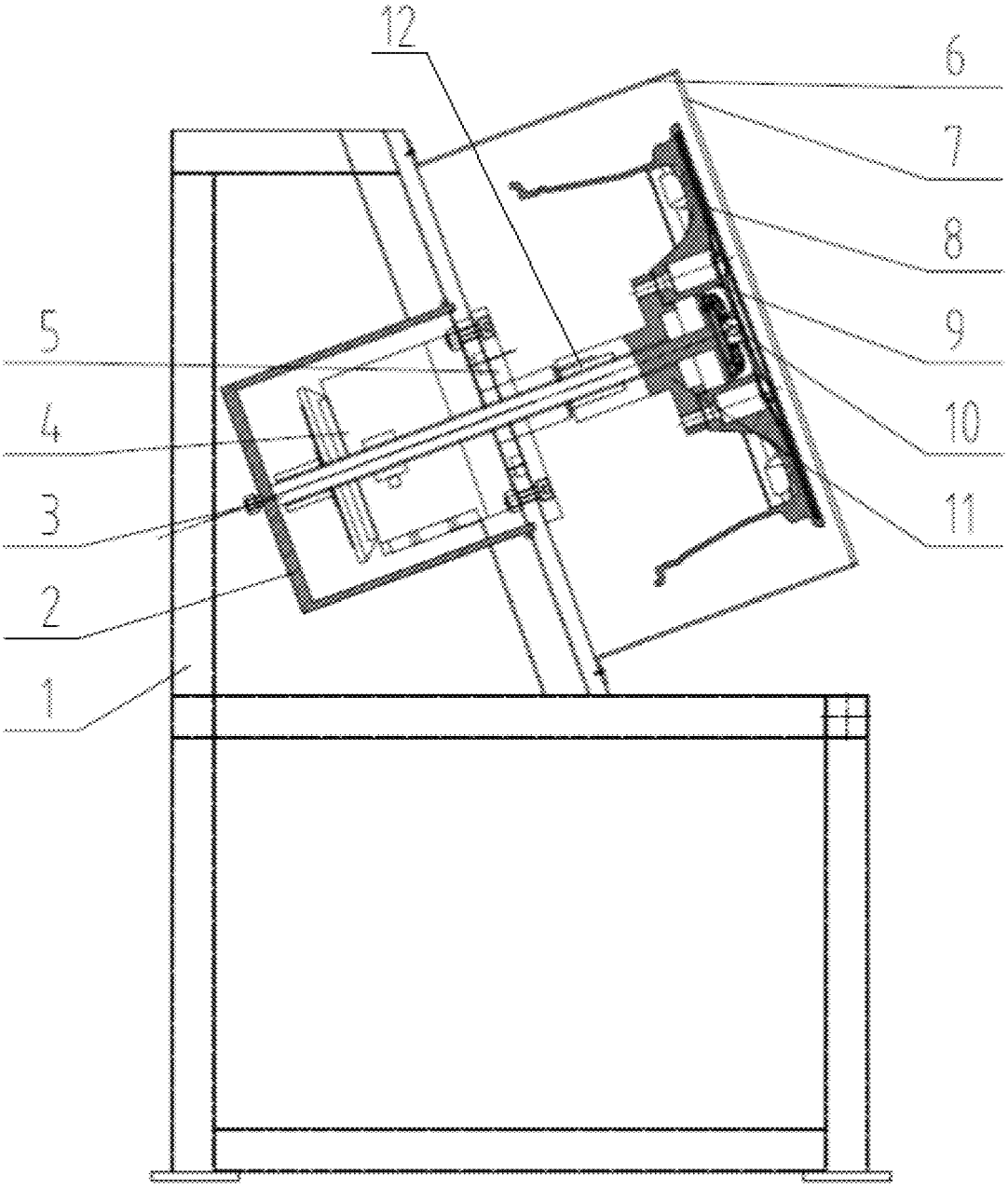
FIG. 1 is a schematic diagram of a wheel dynamic imaging display rack according to some embodiment of the present disclosure.

Reference numerals: 1. frame, 2. positioning seat, 3. positioning frame, 4. hollow shaft motor, 5. sleeve, 6. protective device, 7. transparent protective cover, 8. LED lamp blade, 9. wheel, 10. LED lamp holder assembly, 11. flange, 12. pin and/or key, 13. storage battery, 14. controller.

DETAILED DESCRIPTION

It should be noted that, the embodiments in the disclosure and the features in the embodiments can be combined with each other without conflict.

The technical solutions of the present disclosure will be described clearly and completely hereinafter with reference to the accompanying drawings in conjunction with the embodiments. Obviously, the described embodiments are only a part of the embodiments of the disclosure and not all of them. Based on the embodiments in the disclosure, all other embodiments obtained by a person skilled in the art without creative efforts are within the scope of the disclosure.

Figure 2:
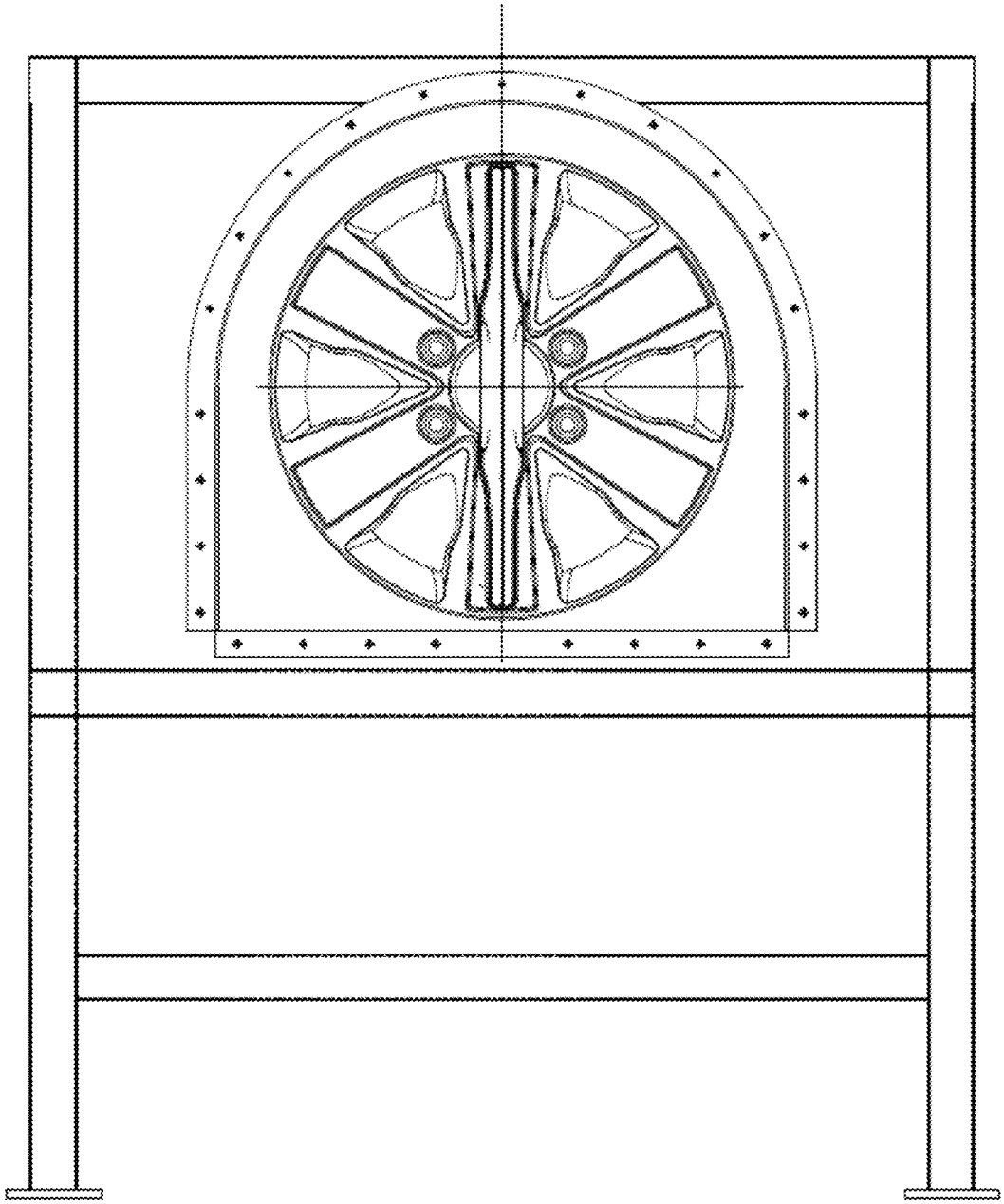
FIG. 2 illustrates a left view of the wheel dynamic imaging display rack according to some embodiment of the present disclosure.
Figure 3:
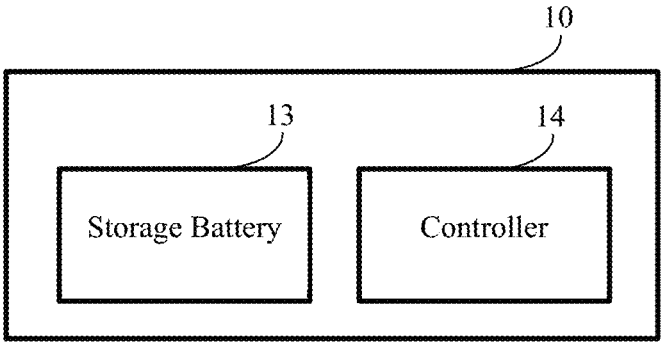
FIG. 3 is a block diagram of the LED lamp holder assembly.

The wheel dynamic imaging display rack of the embodiment of the present disclosure will be described below with reference to FIGS. 1-3 in combination with the embodiment.

A wheel dynamic imaging display rack includes a frame 1, a sleeve 5 is fixed to the frame 1, a hollow shaft motor 4 is fixed to the sleeve 5, the hollow shaft of the hollow shaft motor 4 is fixedly connected to the wheel 9 through the sleeve 5, a positioning frame 3 passing through the hollow shaft is disposed in the hollow shaft of the hollow shaft motor 4, one end of the positioning frame 3 is fixed to the frame 1, the other end of the positioning frame 3 is fixed with an LED lamp holder assembly 10, an LED lamp blade 8 is provided on the outer surface of the spoke of the wheel 9, and the LED lamp holder assembly 10 can control the image display of the LED lamp blade 8. The hollow shaft motor 4 can drive the flange 11, the wheel 9 and the LED lamp blade 8 to rotate. At this time, the LED lamp blade 8 rotates at a high speed with respect to the LED lamp holder assembly 10. Clear images are shown in the LED lamp blade 8 by means of the control system of the LED lamp holder assembly 10.

In one embodiment, the hollow shaft is fixedly connected to the wheel 9 by means of a flange 11, one end of the flange 11 is fixedly connected to a flange surface of the wheel 9, and the other end of the flange 11 is fixedly connected to the hollow shaft.

In one embodiment, the other end of the flange 11 is fixedly connected to the hollow shaft by means of a pin and/or a key 12.

In one embodiment, the protective device 6 is provided at the outside of the rim of the wheel 9, the transparent protective cover 7 is provided at the outside of the spoke of the wheel 9, and the transparent protective cover 7 is fixed to the protective device 6. The transparent protective cover 7 can effectively prevent people from contacting the high-speed rotating wheel 9 and causing injury, while not affecting the display effect of the LED light.

In one embodiment, the positioning seat 2 fixed to the frame 1 is provided at the outside of the hollow shaft motor 4, one end of the positioning frame 3 is fixed to the positioning seat 2, and the other end of the positioning frame is fixed with the LED lamp holder assembly 10.

In one embodiment, the LED lamp holder assembly 10 includes a storage battery 13 and a controller 14, the storage battery 13 can supply power to the LED lamp blade 8, and the controller 14 can control the image display of the LED lamp blade 8.

In one embodiment, the LED lamp blade 8 includes a plurality of display lamp beads. When the LED lamp blade 8 rotates at a high speed with respect to the LED lamp holder assembly 10, clear images are shown in a plurality of display lamp beads of the LED lamp blade 8 by means of the control system of the LED lamp holder assembly 10.

In one or more embodiments, the LED lamp blade 8 and the LED lamp holder assembly 10 can rotate relative to each other. a storage battery 13 is provided in the LED lamp holder 10 to supply power to the LED display lamp beads in the LED lamp holder 10. When the LED lamp blade 8 rotates at a high speed with respect to the LED lamp holder assembly 10, clear images are shown in a series of display lamp beads of the LED lamp blade 8 by means of the controller 14 of the LED lamp holder assembly 10.

Compared with the prior art, the wheel dynamic imaging display rack of the present disclosure has the following advantages:

With the ingenious design of the upper and lower working positions, the loading, unloading, drying and cleaning are separated and operated at the same time, greatly shortening the production cycle and improving the production efficiency.

While exemplary embodiments are described above, it is not intended that these embodiments describe all possible forms of the present disclosure. Rather, the words used in the specification are words of description rather than limitation, and it is understood that various changes may be made without departing from the spirit and scope of the present disclosure. Additionally, the features of various implementing embodiments may be combined to form further embodiments of the present disclosure.

What is claimed is:

1. A wheel dynamic imaging display rack, comprising:

a frame;

a sleeve being fixed to the frame;

a hollow shaft motor fixed to the sleeve;

a hollow shaft of the hollow shaft motor fixedly connected to a wheel through the sleeve;

a positioning frame passing through the hollow shaft, the positioning frame is disposed in the hollow shaft of the hollow shaft motor, one end of the positioning frame being fixed to the frame, the other end of the positioning frame being fixed with an LED lamp holder assembly; and an LED lamp blade provided on an outer surface of a spoke of the wheel, the LED lamp holder assembly being able to control image displaying of the LED lamp blade.

2. The wheel dynamic imaging display rack according to claim 1, wherein: the hollow shaft is fixedly connected to the wheel by means of a flange, one end of the flange is fixedly connected to a flange surface of the wheel, and the other end of the flange is fixedly connected to the hollow shaft.

3. The wheel dynamic imaging display rack according to claim 2, wherein the other end of the flange is fixedly connected to the hollow shaft by means of a pin and/or a key.

4. The wheel dynamic imaging display rack according to claim 3, wherein: a positioning seat fixed to the frame is provided outside the hollow shaft motor, one end of the positioning frame is fixed to the positioning seat, and the other end of the positioning frame is fixed with the LED lamp holder assembly.

5. The wheel dynamic imaging display rack according to claim 4, wherein the LED lamp blade comprises: a plurality of display lamp beads.

6. The wheel dynamic imaging display rack according to claim 2, wherein: a protective device is provided outside a rim of the wheel, a transparent protective cover is provided outside the spoke of the wheel, and the transparent protective cover is fixed to the protective device.

7. The wheel dynamic imaging display rack according to claim 6, wherein the LED lamp holder assembly comprises:

a storage battery, and a controller, the storage battery can supply power to the LED lamp blade, and the controller can control the image displaying of the LED lamp blade.

* * * * *